United States Patent [19]

Ustin et al.

[11] Patent Number: 4,609,246

[45] Date of Patent: Sep. 2, 1986

[54] DEAD-FRONT TERMINAL BLOCK WITH MOVABLE COVERS

[75] Inventors: George Ustin, Croton-on-Hudson; Andrew P. Soltis, Yonkers, both of N.Y.

[73] Assignee: North American Philips Corporation, New York, N.Y.

[21] Appl. No.: 743,263

[22] Filed: Jun. 10, 1985

Related U.S. Application Data

[63] Continuation of Ser. No. 452,573, Dec. 23, 1982, abandoned.

[51] Int. Cl.[4] ..... H01R 9/00

[52] U.S. Cl. ..... 339/59 M; 339/198 J

[58] Field of Search ..... 339/59 R, 59 M, 198 R, 339/198 J, 210 R, 210 M

[56] References Cited

U.S. PATENT DOCUMENTS

| | | | |
|---|---|---|---|
| 3,247,480 | 4/1966 | Orzechowski | 339/198 G |
| 3,904,266 | 9/1975 | Fitzpatrick | 339/126 R |
| 3,992,072 | 11/1976 | Anhalt et al. | 339/210 M |
| 4,025,151 | 5/1977 | Eigenbrode | 339/210 M |
| 4,066,321 | 1/1978 | Villazon | 339/98 |
| 4,099,826 | 7/1978 | Mazzeo et al. | 339/198 R |
| 4,180,305 | 12/1979 | Ustin et al. | 339/198 H |
| 4,348,070 | 9/1982 | Simon | 339/59 R |

FOREIGN PATENT DOCUMENTS

| | | | |
|---|---|---|---|
| 7409896 | 6/1974 | Fed. Rep. of Germany . | |
| 2649390 | 4/1978 | Fed. Rep. of Germany | 339/198 J |
| 2071926 | 9/1981 | United Kingdom | 339/210 M |

*Primary Examiner*—Gil Weidenfeld
*Assistant Examiner*—Gary F. Paumen
*Attorney, Agent, or Firm*—William J. Streeter; Leroy Eason

[57] ABSTRACT

A terminal block assembly configured to prevent inadvertent contact with terminals in sections of the block defined by pairs of barriers. Hinged covers are integrally molded with the barriers to enable closing of open sides of respective sections.

6 Claims, 5 Drawing Figures

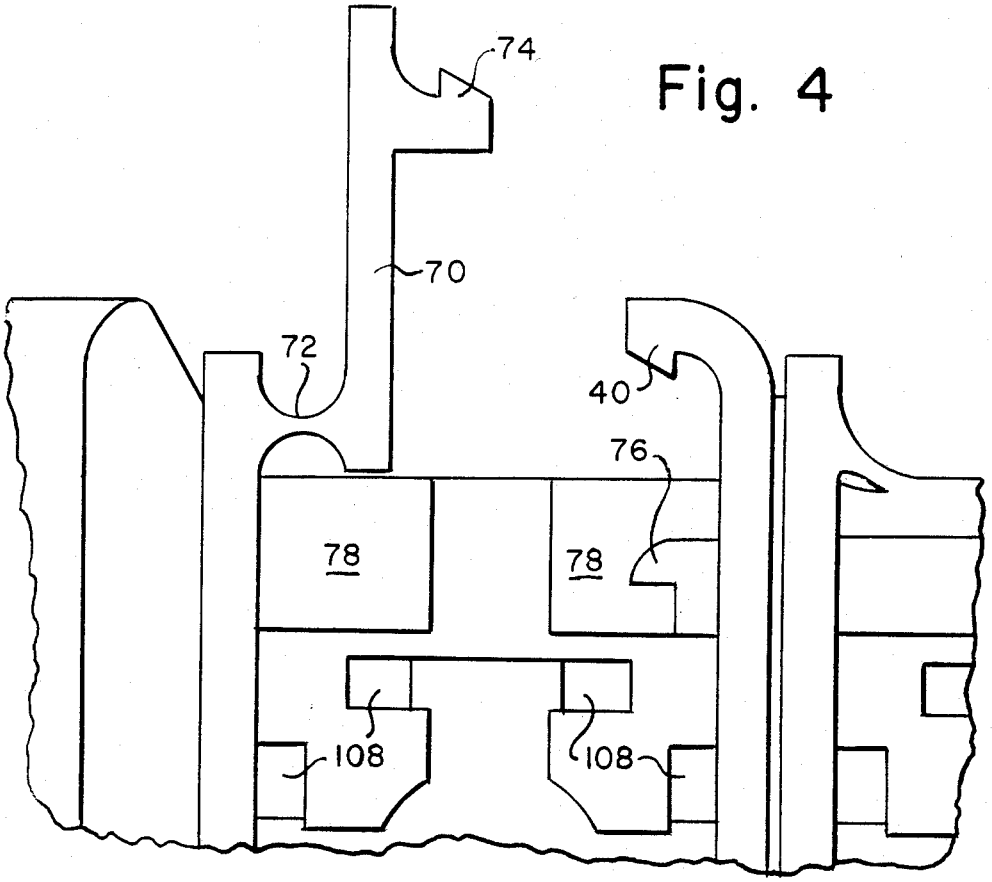
Fig. 4
Fig. 5
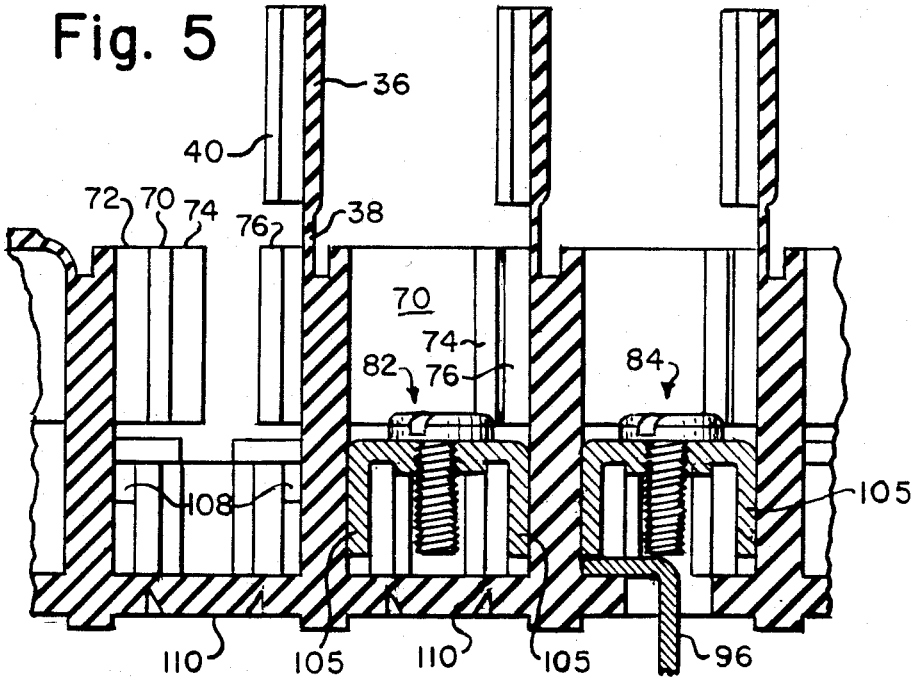

DEAD-FRONT TERMINAL BLOCK WITH MOVABLE COVERS

This is a continuation of application Ser. No. 452,573, filed Dec. 23, 1982, now abandoned.

BACKGROUND OF THE INVENTION

1. Field of the Invention

This invention relates to terminal block assemblies of the type including a plurality of electrically isolated sections, each having a terminal located therein. In particular, the invention relates to terminal block assemblies having dead-front protection. With this type of protection the terminals located in the sections are at least partially covered, so that shock and short circuit hazards are minimized. Such protection is not only desirable but, for certain applications, is required under UL Standards in the United States and under VDE Standards in Western Europe.

2. Description of the Prior Art

A portion of a conventional dead-front terminal block assembly is illustrated in FIG. 1. This terminal block assembly consists of a one piece insulating molding 10 having a plurality of hollow sections 12, each containing a tubular clamp terminal 14. Each terminal comprises a tubular conductor 16, open at both ends, a pair of clamping screws 18 mounted in respective threaded holes formed in one side of the tubular conductor adjacent the open ends, and a clamping strap 20 passing through the tubular conductor near the side having the threaded holes. Each section 12 of the insulating molding 10 has openings 22 at opposite ends providing access to the opposite ends of the tubular conductor 16 located in the section for enabling the insertion of wires or other conductive elements which are to be electrically-connected to each other by the tubular conductor. The insulating molding 10 also includes hollow extensions 24 for enclosing the heads of the clamping screws 18. The end of each hollow extension has an access opening 26 for inserting a screwdriver or test prod. The screws 18 mounted in each tubular conductor are turned after insertion of wires (not shown) into opposite ends of the tubular conductor, forcing the ends of the respective clamping strap 20 against the wires to clamp them in place.

In dead-front terminal blocks such as that shown in FIG. 1, access to the terminals and the clamping screws is restricted, but none of the openings providing access are covered as is sometimes desired. For example, it is sometimes necessary to mount a terminal block with one side in close proximity to circuitry, such as on a circuit board itself, with one side abutting circuitry on the board. In this case, it is desirable to cover the side of the terminal block to provide an effective barrier against short circuits, while still enabling connection of selected terminals to the circuitry. Also, the type of terminal block shown in FIG. 1 is limited to a specific type of tubular terminal, and cannot accept many of the terminal types commonly used with terminal blocks. For example, right angle feed-through terminals cannot be inserted through the small openings in the terminal block. Additionally, it is difficult to assemble the tubular terminals used, because the clamping screws cannot be mounted in the threaded holes of the tubular conductors until both the clamping screws and the tubular conductors are inserted into the hollow sections. After insertion, the ends of the screws must be aligned with the threaded holes, while both are hidden from view by the insulating block material.

Terminal blocks which are suitable for mounting on circuit boards in close proximity to circuitry are disclosed in U.S. Pat. Nos. 3,904,266 and 4,099,826. The terminal blocks disclosed in these patents each comprises a block of insulating material having a base portion in which are mounted a plurality of terminals separated by molded barriers defining individual sections of the terminal block. A molded wall is provided at the back of each section to serve as a protective barrier against electrical contact with circuitry or other conductive elements located behind the wall. The back walls include respective openings to facilitate the electrical connection of conductive elements located behind the walls to the terminals in the sections, but specially-shaped feed-through terminals with deformable contact elements must be used. Besides this limitation, no means is provided for providing dead front protection at the front or top sides of the terminals.

Terminal blocks having covers on their top sides are disclosed in U.S. Pat. No. 4,180,305, which has the same inventors as the present application, and in U.S. Pat. No. 3,247,480. Each of these terminal blocks includes a cover which snaps over the top of barriers between adjacent terminals. The cover is pivoted away or removed from the top side of the terminal block to gain access to the terminals. Protection will be lost, however, if the cover is misplaced, and no means is provided for closing the front or back side of the sections.

SUMMARY OF THE INVENTION

An object of the invention is to provide a dead-front terminal block having cover means which may be provided on any or all open sides of individual sections of the terminal block.

Another object of the invention is to provide such a dead-front terminal block where the cover means need not be removed from the terminal block to give unrestricted access to the terminals in the sections.

Yet another object of the invention is to provide a dead-front terminal block which accepts any of the terminal types commonly used with conventional barrier type terminal blocks.

Still another object of the invention is to provide a dead-front terminal block which can be made in a simple mold and in which the terminals used in the sections can be assembled without difficulty.

These and other objects of the invention are accomplished by providing an elongated terminal block having a particular configuration which enables individual covers for respective sections to be integrally molded with longitudinally spaced barriers, each extending from three sides of the block. Each adjacent pair of barriers defines a terminal mounting section having three open sides. Each cover is joined to an edge of the respective barrier with which it is molded by a reduced thickness portion forming an integral hinge, and includes means for latching with an adjacent barrier to close one of the open sides of the section defined by these barriers. The covers are oriented so that, when open, they extend in the same direction as the barriers, enabling the terminal blocks be made in a simple mold. The covers can be selectively provided to close any or all open sides of the individual sections, and can be opened to provide unrestricted access enabling common terminal types to be easily installed and used.

BRIEF DESCRIPTION OF THE DRAWING

FIG. 4 is an enlarged top view of a portion of one of the sections of the terminal block illustrated in FIG. 3.

FIG. 5 is a sectional view of the FIG. 3 embodiment taken along the line 5—5.

DESCRIPTION OF THE PREFERRED EMBODIMENTS

Figure 1:
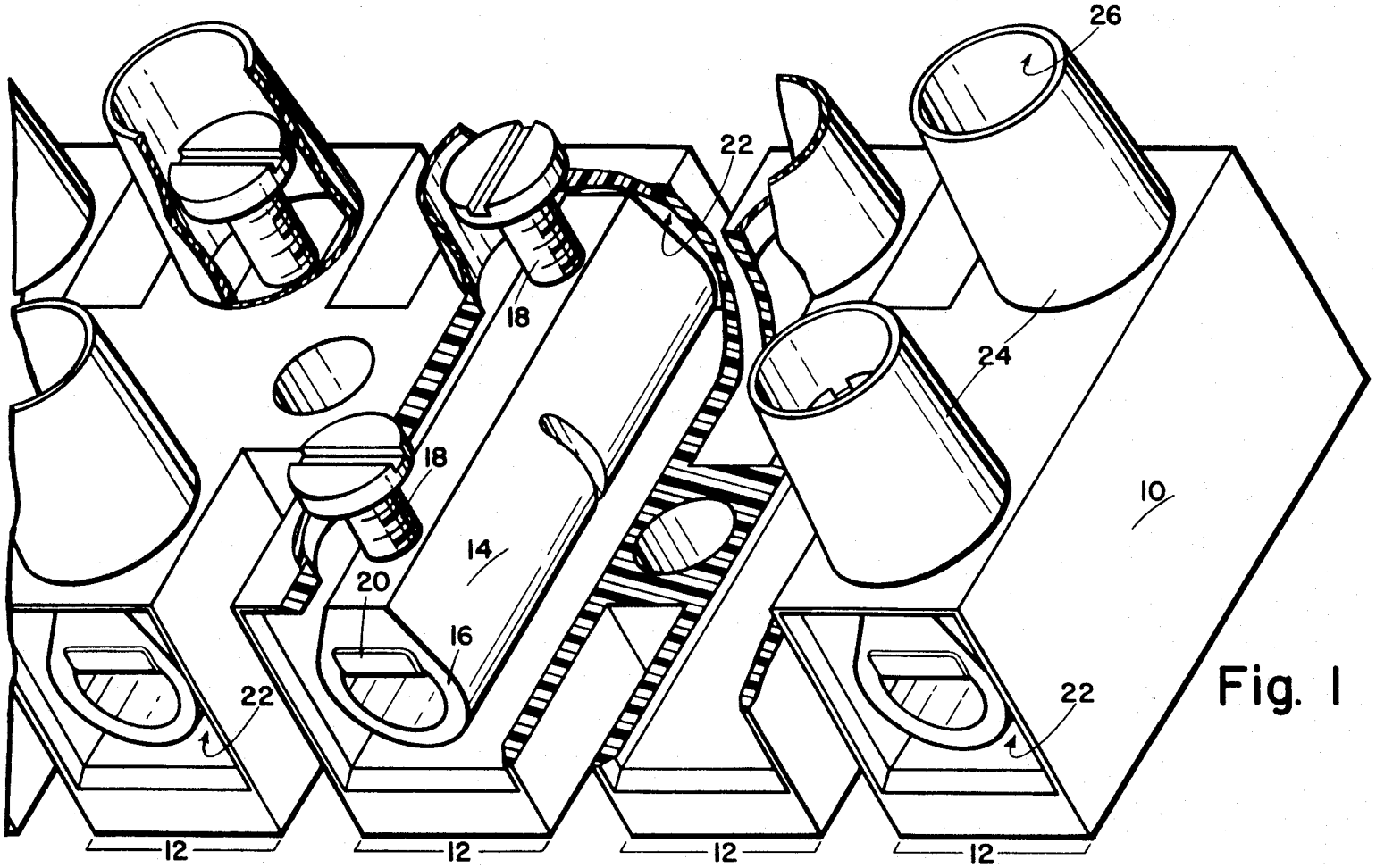
FIG. 1 is a perspective view of a segment of a prior art terminal block assembly.
Figure 2:
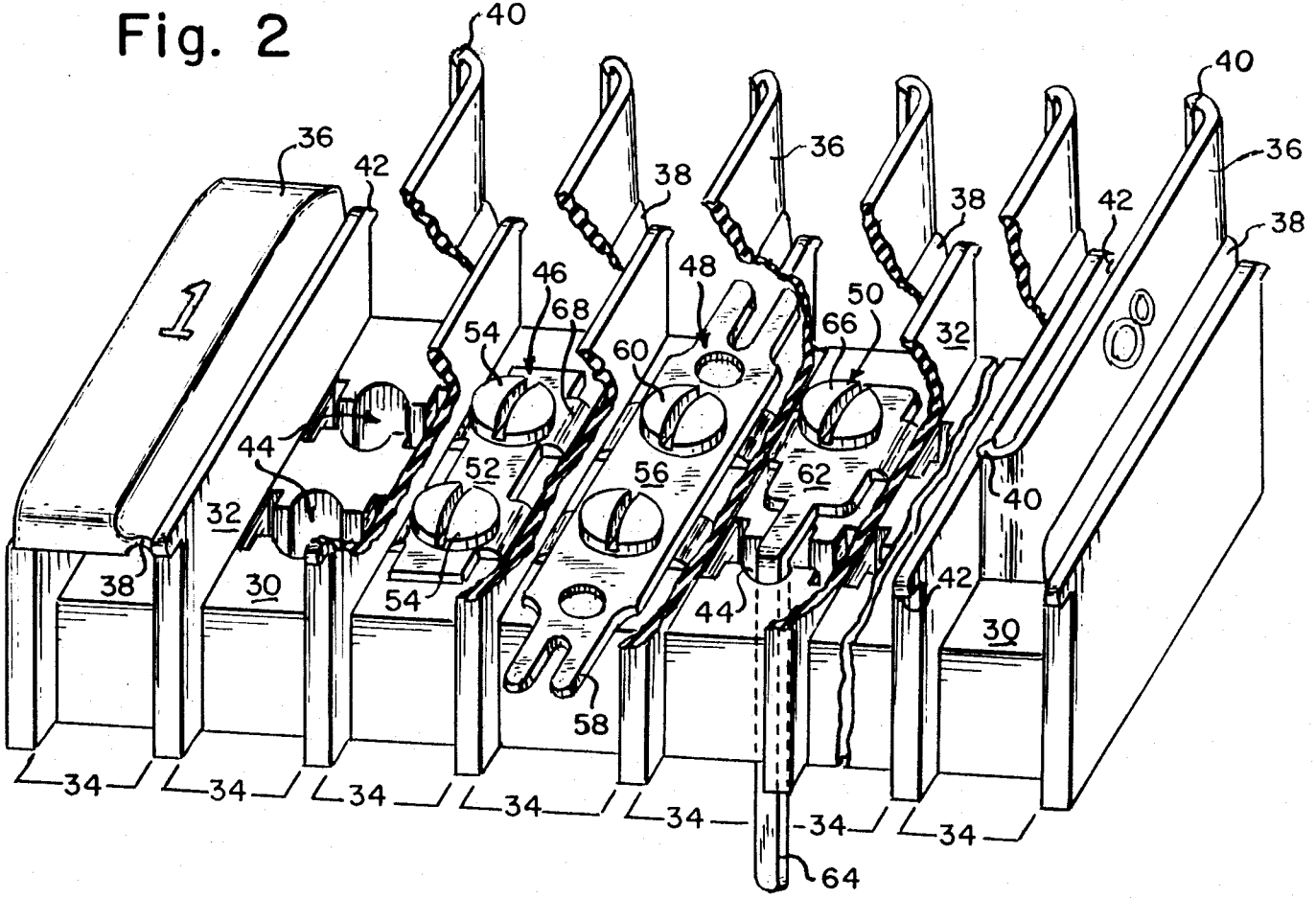
FIG. 2 is a perspective view of one embodiment of a terminal block assembly in accordance with the invention.

The examplary embodiment of the invention illustrated in FIG. 2 is a double row terminal block providing dead-front protection on the top side. The terminal block is molded as an elongated block 30 of insulating material having a plurality of barriers 32, each extending from top, front and back sides of the block. Each adjacent pair of barriers defines a section 34 having corresponding top, front and back open sides.

A plurality of covers 36 for closing the top sides of the sections are joined to the barriers 32. Each of these covers is joined to a top edge of a respective barrier by means of a reduced thickness integral hinge 38 formed during molding of the terminal block. The terminal block is molded with the covers in the open position to simplify removal of the block from the mold, and to produce hinges which are unstressed in this position, thus automatically opening the covers when they are unlatched.

A plurality of latching means are provided for holding the respective covers closed. The latching means for each cover includes flexible, hook-shaped portions 40 molded on the cover for engaging with tabs 42 molded on an adjacent barrier. The hook-shaped portions and the tabs latch when the respective cover is closed, but can be easily unlatched to open the cover because of the flexibility of the hook-shaped portions. Although each hook-shaped portion has been provided along an entire edge of a cover to simplify molding, it need only be provided at the end of the edge which engages the tab on the adjacent barrier. Further, only one hook-shaped portion and tab need be provided for each section, rather than two each as has been illustrated.

The block of insulating material 30 has holes 44 formed in each section which are appropriately shaped for accepting a variety of terminal types. The holes serve as both means for mounting the terminals and as feed-through passages. Three different types of terminals are illustrated, but the terminal block will accommodate any type of terminal commonly used with conventional barrier type terminal blocks. The types of terminals illustrated are a screw terminal 46, a screw/-lug terminal 48 and a right angle feed-through terminal 50. Terminal 46 comprises a conductive member 52 for electrically connecting wires or other conductors clamped to the member by screws 54 threaded into holes in the member. Terminal 48 comprises a conductive member 56 for electrically connecting conductors soldered to lug portions 58 and clamped to the member by screws 60. Terminal 50 comprises a conductive member 62 for electrically connecting conductors attached to a wire-wrap portion 64 and clamped to the member by a screw 66. The portion 64 is bent at a right angle for feeding through one of the holes 44 in the block 30 to facilitate electrical connection to the terminal at the bottom side. Each terminal also includes a pair of arms 68 inserted in slot-shaped portions of the holes 44 for securing the terminal in the block. These arms may be formed similarly to those illustrated in FIG. 5 of the above-mentioned U.S. Pat. No. 4,180,305.

Figure 3:
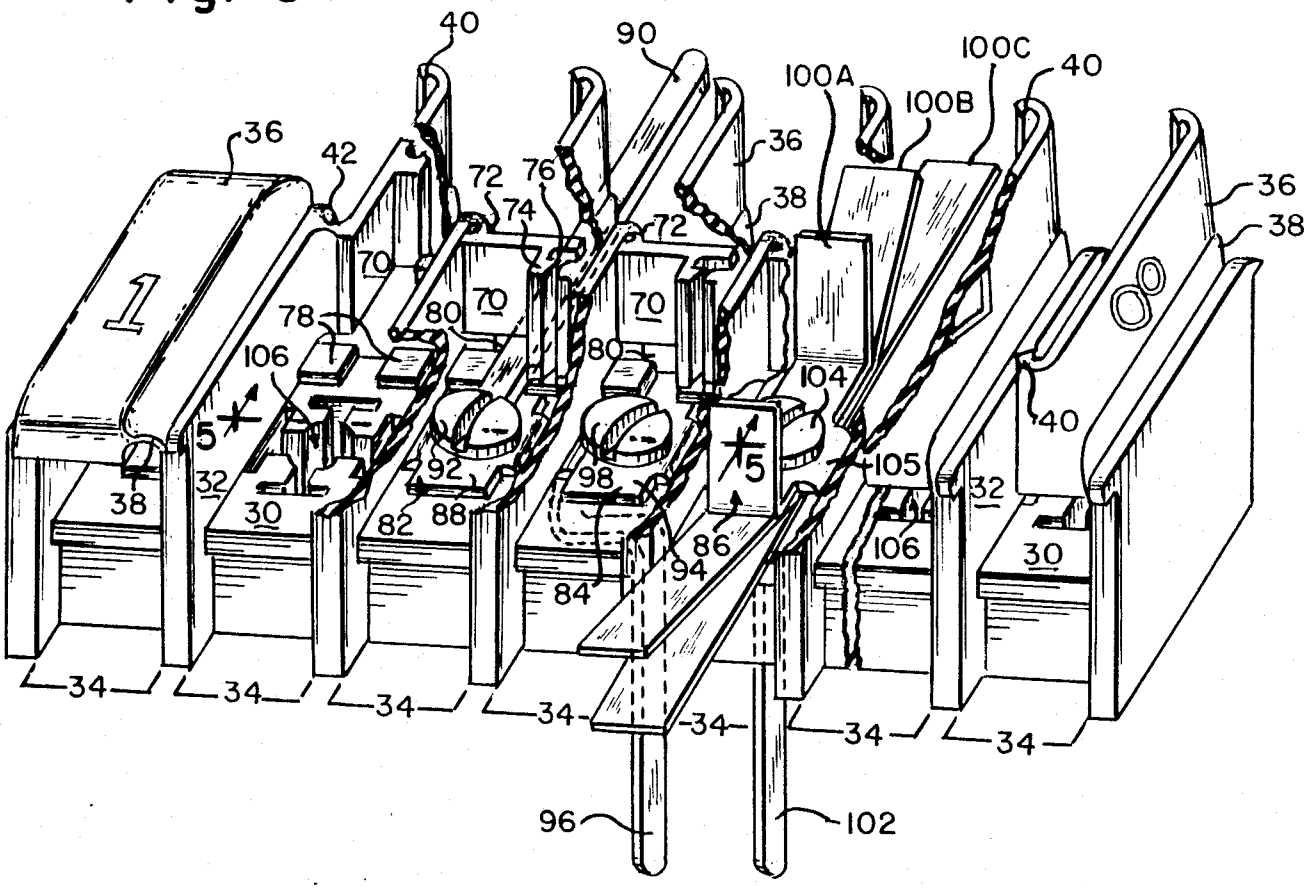
FIG. 3 is a perspective view of another embodiment of a terminal block assembly in accordance with the invention.

FIG. 3 illustrates another embodiment of a terminal block configured in accordance with the invention. This terminal block has dead-front protection on both the top and the back sides. Elements of this terminal block corresponding to those in the FIG. 2 embodiment are identically numbered. These elements include a block of insulating material 30, barriers 32 defining sections 34, top side covers 36 having integral hinges 38 and latching means including hook-shaped portions 40 and tabs 42.

In addition to these elements, the terminal block includes a plurality of covers 70 which are each joined to a back edge of a respective barrier by means of a reduced thickness integral hinge 72. This terminal block is molded with both the top and back covers in the open position to simplify the molding process and to provide hinges which automatically open the covers when unlatched. A latching means for holding each of the back covers closed is illustrated both in FIG. 3 and in FIG. 4, which is an enlarged top view of the back portion of one of the sections in the terminal block. This latching means comprises a flexible, hook-shaped portion 74 molded on the back cover for engaging with a tab 76 molded on an adjacent barrier. Although both the hook-shaped portions 74 and the tabs 76 are shown in FIG. 3 as having lengths approximating the height of the barriers, these lengths can be shortened if desired.

When the back covers are closed, they can serve to limit access to the sections from the back side or they can serve as barriers which permit the back side of the terminal block to be safely mounted against circuitry or conductive elements. To facilitate connection with such circuitry or conductive elements without sacrificing the dead-front protection provided by the back covers, the bottom of each cover 70 is situated above two raised floor portions 78 of the respective section such that the cover and the raised floor portions form an opening 80 when the cover is closed. This opening enables a conventional feed-through terminal such as terminal 82 to be used for connection with circuitry or conductive elements behind the barrier formed by the cover.

The exemplary terminals illustrated in FIG. 3 include the terminal 82, a right angle feed-through terminal 84 and a feed-through/quick connect terminal 86. Terminal 82 comprises a conductive member 88 for electrically connecting conductors attached to a wire wrap portion 90 and clamped to the member by a screw 92. The portion 90 extends through one of the openings 80 in the back of the terminal block and may either be directly connected or wired to elements mounted behind the terminal block. Terminal 84 comprises a conductive member 94 for electrically connecting conductors attached to a wire wrap portion 96 and clamped to the member by a screw 98. Terminal 86 comprises a conductive member including blade-shaped portions 100A, 100B, 100C for electrically connecting quick connect connectors (not shown), which can be slipped onto the ends of these portions, with conductors attached to a wire wrap portion 102 and clamped to member 100A by a screw 104. The wire wrap portion 102 is an extension of one of the blade-shaped portions 100A, 100B, 100C, which are either clamped together by the screw 104 or are welded together.

Each of the terminals 82, 84, 86 include a pair of arms 105 for securing them in holes 106 formed in the terminal block. These arms and holes are similar to the arms 68 and holes 44 in the FIG. 2 embodiment, but the holes 106 each include four arm receiving slots enabling insertion of each terminal in any of four different orientations. As is shown in FIG. 4, the terminal block can be provided with ramps 108 for facilitating insertion of the arms into the slots. The arms themselves preferably have serrated or notched edges for engaging the bottoms of the ramps. The terminals can be secured in the terminal block by means of this engagement alone or they can be fixed in place by ultrasonic welding or an adhesive.

FIG. 5 is a sectional view of three adjacent sections of the terminal block illustrated in FIG. 3. This view is taken along line 5—5 and shows the interior of an empty hole 106 and the manner in which the terminals 82 and 84 are situated in their respective holes. The terminal block preferably includes knock-out plugs 110 for closing the bottoms of the holes in sections which do not contain terminals having feed-through portions extending through the bottom of the block.

Although the above description has disclosed exemplary embodiments of the invention, various modifications can be made without departing from the scope of the invention. For example, covers can be formed on all three of the open sides of the terminal block defined by the barriers. In any configuration, the user can selectively remove covers that are not desired by merely cutting the relatively thin, hinged portions of those covers.

We claim:

1. A dead front terminal block comprising:

(a) an elongated block of insulating material having a plurality of longitudinally spaced parallel planar barriers each protruding from three sides of the block, each adjacent pair of barriers defining a terminal receiving section having three open sides, a portion of the block in each section including a mounting hole for said terminal;

(b) a plurality of movable covers for closing respective ones of said open sides, each cover having substantially one entire edge integrally molded to an hingedly movable on substantially one entire edge of one of the barriers defining a section, when open said cover extending coplanar with and in the same direction as the barrier to which it is molded, and when closed said cover engaging the adjacent barrier defining said section;

(c) a plurality of latching means for holding the covers closed, the latching means for each cover comprising a member molded on the cover and a tab molded on said adjacent barrier which is engaged by said cover member when said cover is closed; and (d) a plurality of terminals mounted in respective ones of the sections.

2. A dead front terminal block as in claim 1 wherein the latching means member molded on each cover is a flexible hook-shaped portion molded on an edge of the cover for engaging with the corresponding latching member tab.

3. A dead front terminal block as in claim 1 wherein said movable covers are integrally molded to and hingedly movable on top edges of the barriers.

4. A dead front terminal block as in claim 1 wherein said movable covers are integrally molded to and hingedly movable on side edges of the barriers.

5. A dead front terminal block as in claim 4 where each of said moveable covers cooperates with the block of insulating material to define an opening under the cover facilitating feed through connection with respect to the side closed by said cover.

6. A dead front terminal block as in claim 2 wherein the latching means tab is coplanar with the barrier on which it is molded.

* * * * *